United States Patent [19]

Granholm et al.

[11] 3,976,149

[45] Aug. 24, 1976

[54] ROCK DRILL EQUIPMENT HAVING A MECHANIZED DRILL BIT EXCHANGE

[75] Inventors: Sven Granholm; Börje Meijer, both of Skelleftea, Sweden

[73] Assignee: Linden-Alimak AB, Skelleftea, Sweden

[22] Filed: Jan. 30, 1975

[21] Appl. No.: 545,450

Related U.S. Application Data

[63] Continuation of Ser. No. 330,530, Feb. 8, 1973, abandoned.

[30] Foreign Application Priority Data

Feb. 8, 1972 Sweden ..... 1454/72

[52] U.S. Cl. ..... 175/52; 175/85; 173/46; 211/1.5; 211/69

[51] Int. Cl.[2] ..... E21C 19/04

[58] Field of Search ..... 175/52, 85; 211/60 T, 211/69, 1.5; 308/3.9; 173/146, 46; 166/50; 81/57.31, 54, 57.37, 57.23

[56] References Cited

UNITED STATES PATENTS

| | | | |
|---|---|---|---|
| 2,781,185 | 2/1957 | Robbins | 175/85 X |
| 2,878,700 | 3/1959 | Reynolds | 81/57.37 |
| 2,889,137 | 6/1959 | Walker | 166/50 X |
| 2,909,288 | 10/1959 | Boudette | 175/85 X |
| 3,286,777 | 11/1966 | Gyongyosi | 175/85 X |
| 3,291,225 | 12/1966 | Foran | 173/164 |
| 3,541,900 | 11/1970 | Mosier | 81/57.37 |
| R28,371 | 3/1975 | Van Winkle | 173/164 |

*Primary Examiner*—Ernset R. Purser
*Assistant Examiner*—Richard E. Favreau
*Attorney, Agent, or Firm*—Fred Philpitt

[57] ABSTRACT

At a rock drill, preferably most forwardly on its frame, a magazine with drill bits is arranged. When a drill bit has been worn such that it must be exchanged, the drill rod is retracted so much that the worn drill bit arrives at the magazine. By special means at the magazine the worn bit is unscrewed from the rod and replaced by a new bit from the magazine.

12 Claims, 5 Drawing Figures

40
41
44
42
43
44
42
30
8
31
31
38
39
36
37
35
3
47
48
49
V
V
40
45
46
35
30
33
32
32
34
35A
31
8
31

ROCK DRILL EQUIPMENT HAVING A MECHANIZED DRILL BIT EXCHANGE

This is a continuation of application Ser. No. 330,530, filed Feb. 8, 1973 now abandoned.

This invention relates to a device for use with rock drill equipment for exchange a drill bit on the drill rod.

Drift mining and tunnel driving in underground and construction operations are to an ever increasing extent carried out by means of special drift mining assemblies. Previously, these assemblies were adapted for use only when the drifts and tunnels to be driven were substantially horizontal. Owing to the further development, however, it has become possible by drill assemblies to mechanize to a large extent also the driving of inclined drifts, above all such having angles of inclination up to approximately the angle of repose of the material broken.

The number of drill holes in a round varies strongly with the drift cross-section and rock type. Today, drilling usually is carried out with pneumatic rock drills and to a large extent by using extension rods with exchangeable bits.

The bits wear rapidly and must be exchanged for regrinding. The number of meters drilled between two grinding operations depends on the properties of the rock. The production footage decreases very rapidly when the bit deteriorates in sharpness. When the periods between the exchange of bits are to be determined, it is therefore necessary for achieving optimum productivity, to take into consideration not only the cost of regrinding but also the time required for exchanging the bit.

Today, drill bits are exchanged manually, which is a tedious and difficult task, particularly in inclined drifts where the operator cannot move freely on the drift bottom, and when drill assemblies of such dimensions are used that it is difficult for the operator to carry out the work from the drift bottom or normal working place.

An object of the present invention is to provide a device with which it is possible to exchange drill bits in a time much shorter than required today and without the operator having to leave the control place of the machine. In a multi-frame assembly the operator should be able to exchange the bit in one drill and simultaneously watch the function of the other drills.

SUMMARY OF THE INVENTION

The device according to the invention is intended to be mounted at any of the following locations: on the forward end of the frame supporting the drill at another place on the unit accessible with the frame, on the rock wall or any other suitable place in the immediate vicinity of the drill unit.

The device of the invention comprises apparatus for screwing the worn bit off from the extension rod and for screwing a new bit on the extension rod, and an easily exchangeable magazine in which the drill bits are stored.

The exchange of bits can take place by several alternative methods. In one method the bit is held at the exchange by a wrench member and is screwed off by rotation of the drill rod by means of the machine for separate rotation of the drill. This method, of course, is applicable only with drills provided with such a machine.

According to a second alternative method, which can be applied to drills both with and without separate rotation, the drill rod is held fixed and the bit is rotated by means of a device attached for this purpose.

BRIEF DESCRIPTION OF DRAWING

In the following, embodiments of devices according to the invention are described with reference to the accompanying drawings, in which.

DETAILED DESCRIPTION

Figure 1:
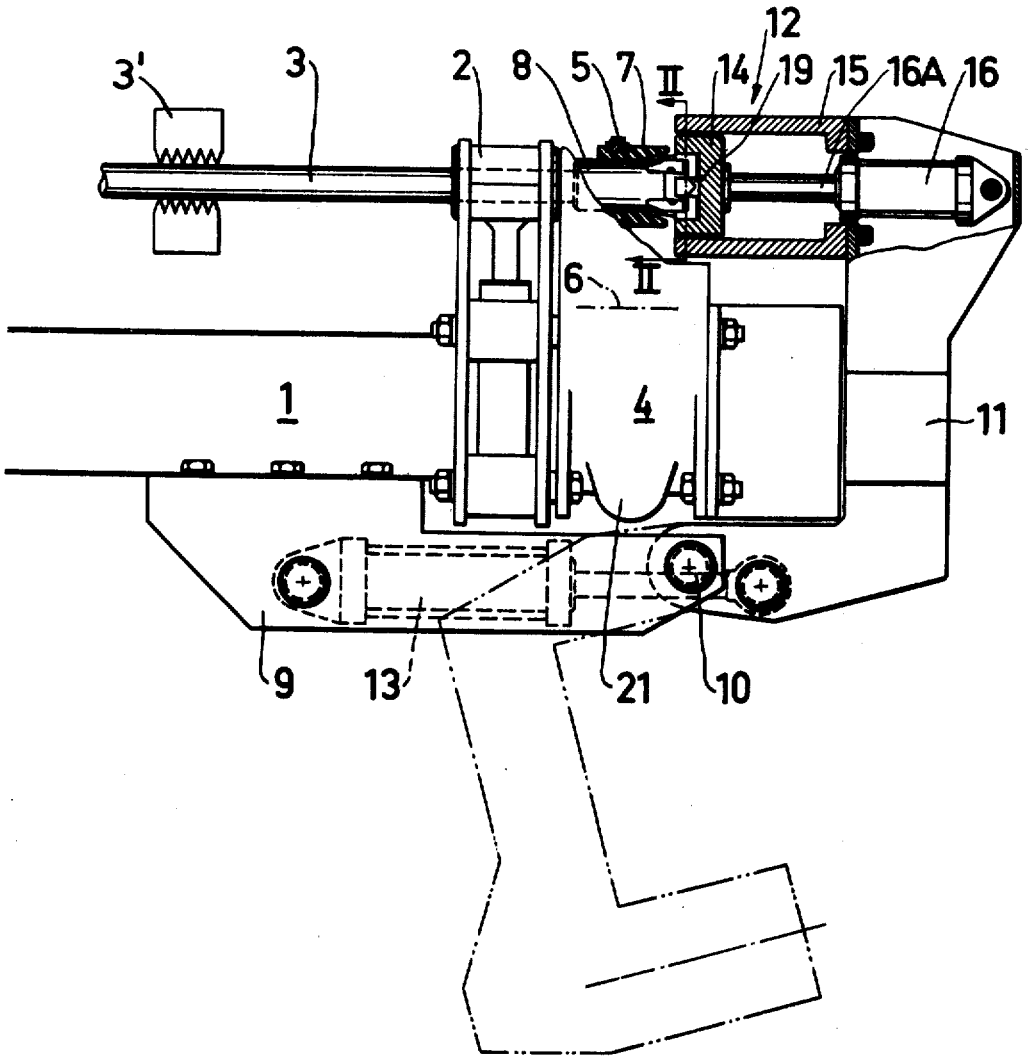
FIG. 1 is a lateral view, partially in section, showing the forward end of a drill comprising a device according to the invention.

Referring to FIG. 1, 1 designates the drill frame, which at its forward end carries a support bearing 2 for the drill rod 3. 4 is a magazine attached to the frame 1, in which magazine exchangeable magazine discs 5 are insertible for rotation about an axle 6. The disc 5 is provided at its circumference with a plurality of equally spaced rubber bushings 7 for enclosing drill bits 8.

The drill frame 1 is extended on its lower side with an arm 9, which at its free end has an arm 11 adapted to pivot about an axle 10, the arm 11 being provided at its free end with members 12 for engaging with the drill bits 8. Said arm 11 can be pivoted by means of a piston-cylinder unit 13 between a position of engagement and a non-operative position (shown in FIG. 1 by dash-dotted lines).

Figure 2:
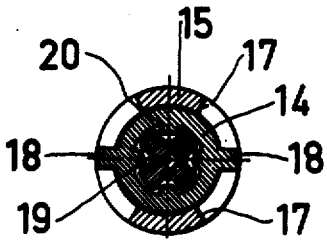
FIG. 2 shows a section taken along line II—II in FIG. 1.

For engagement with the drill bit 8, the member 12 is provided with a wrench member 14, see also FIG. 2, adapted to move within a casing 15. A piston-cylinder unit 16 is arranged between the arm 11 and wrench member 14 for movement of the latter. The wrench member 14 can be turned through about 120° relative to the casing 15. The end positions are determined by stop faces 17 on the casing 15 in coaction with radial projections 18 on the wrench member 14. In its forward end portion the wrench member 14 includes a recess 19 for the drill bit 8. Radially inward directed projections 20 in the recess 19 prevent the drill bit from rotating relative to the wrench member 14 when it is inserted in said member.

When the drill is in operation, the arm 11, as already mentioned, is in the position indicated by dash-dotted lines in FIG. 1. The drill rod extends through the rubber bushing 7 and inwards through the material being drilled to the drill bit 8. When the drill bit 8 is to be exchanged, the drill with the rod 3 is retracted until the bit 8 has entered the rubber bushing 7 and assumes the position shown in FIG. 1. Thereafter the arm 11 is pivoted upwards to its position of engagement. By suitable guide faces in the wrench member 14 and due to its rotatability, the wrench member 14 automatically adjusts to and engages the drill bit 8. Thereafter the rod 3 is rotated without axial movement for screwing off the drill bit. The stroke effected by the projections 18 on the wrench member 14 striking against the stop members 17 on the casing 15 is sufficient to detach the drill bit from the drill rod.

The drill bit when being screwed off is allowed by the piston-cylinder unit 16 to move together with the wrench member 14 and piston rod 16A into the casing 15 until the drill rod 3 is free from the drill bit. The drill rod 3 is retracted until it is free of the bushing 7. The drill bit 8 is again pushed into the bushing 7 by the piston rod 16A. Thereafter the arm 11 with the wrench member 14 is pivoted out of way. The magazine disc 5 is rotated through one step by a rotation device indicated at 21 until a new drill bit 8 assumes the position in front of the drill rod 3. Thereafter the drill with drill rod 3 is moved forward and at the same time the drill rod 3 is rotated for being screwed on the new drill bit. The drill bit fits with force fit in the rubber bushing 7. This force fit is fully sufficient to provide the necessary hold for the drill bit while it is being screwed on the drill rod.

Figures 3, 4, 5:
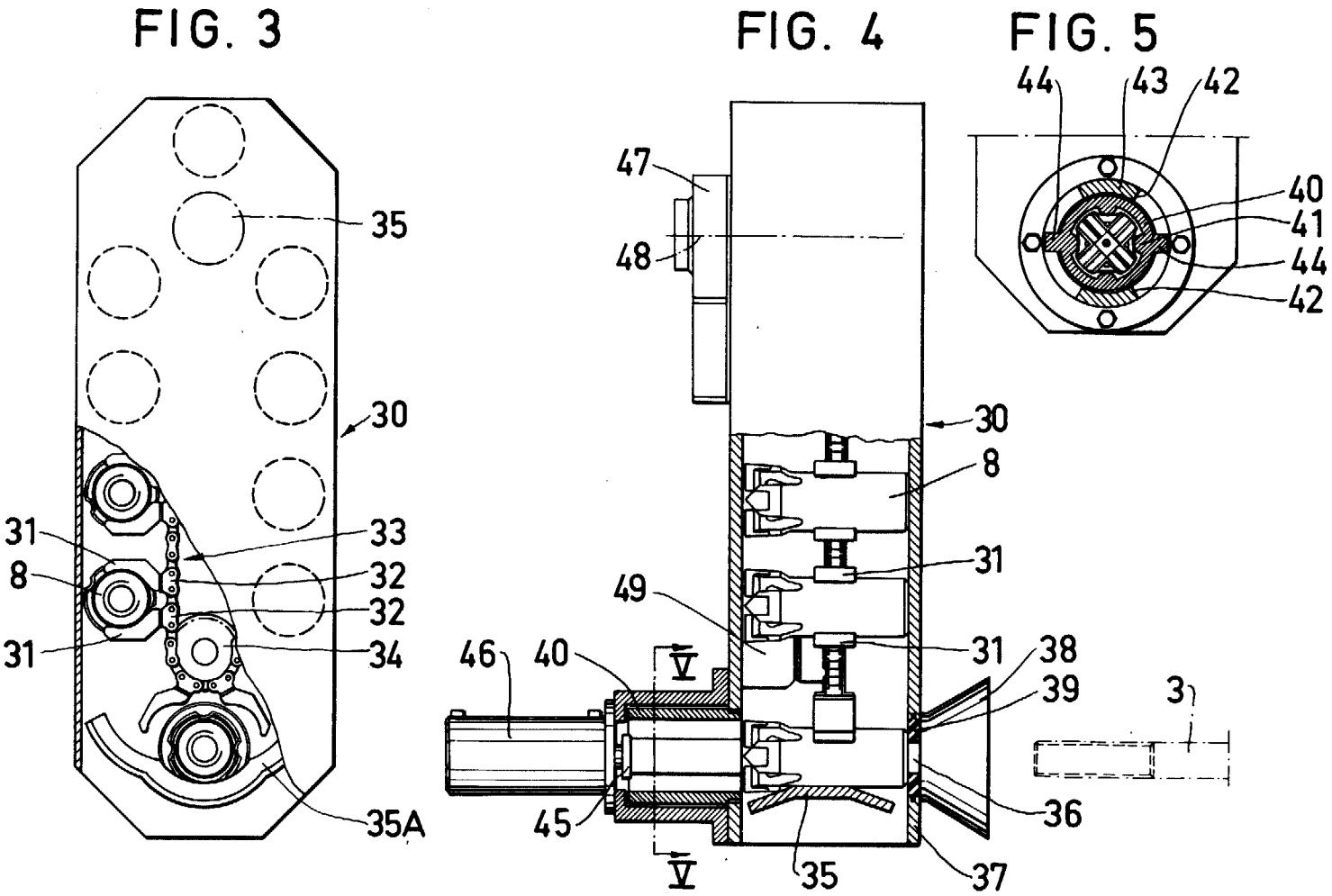
FIG. 3 is by an end view partially cut-open of a type of a bit magazine used in the invention.
FIG. 4 shows the magazine according to FIG. 3 from the side.
FIG. 5 shows a section taken along the line V—V in FIG. 4.

FIGS. 3–5 show another embodiment of a magazine 30 for use with the device according to the invention. The drill bits 8 are held by arms 31, which are secured on links 32 of a chain 33 running over two sprocket wheels 34 and, respectively, 35. The exchange of drill bits 8 on the drill rod 3 takes place below the sprocket wheel 34. Due to the deflection of the chain 33 over the wheel 34, the arms 31 move apart and release the drill bit 8, which assumes a position on the bottom of a curved support member 35A.

When a drill bit is to be exchanged, the drill rod 3 with a drill bit 8 is pushed inward through an aperture 36 in the magazine wall 37. A funnel 38 facilitates the guidance of the bit during this movement. In said aperture 36 is provided a rubber bushing 39, which guides the drill rod 3 in the direction during the screwing-off and -on operations. The drill bit is pushed past the bushing 39 into a wrench member 40, see also FIG. 5, which as the wrench member according to FIG. 2 is prevented by projections 41 from rotating relative to the drill bit 8. The wrench member 40 is of sleeve shape, and the drill bit is axially movable therein. The drill bit having entered the wrench member 40, the axial movement of the drill rod 3 is stopped and the rod instead is rotated to be screwed off. This wrench member is also limited in its rotatability by stop faces 42 of a casing 43 enclosing the wrench member. The stroke, which is effected when the wrench member with the projections 44 strikes against the stop faces 42, is sufficient to detach the drill bit from the drill rod. The drill bit is screwed off and simultaneously is moved axially into the wrench member 40. After a completed screwing-off operation, the drill rod 3 is retracted out of the magazine and the released drill bit is pushed back into the magazine by the end of a piston rod 45 of a piston-cylinder unit 46. Thereafter the chain 33 is caused to move and in conjunction therewith the drill bit located on the support member 35A is caught by the arms 31 (which close on the old bit) and a new drill bit is advanced and placed on the support member 35A. A rotation device indicated at 47 responds by rotating the wheel 35 for the feed of the drill bits.

When the new drill bit is to be screwed on, the drill rod 3 thereafter is again pushed into the magazine and pushes ahead of it the drill bit into the wrench member 40. The drill rod is rotated for screwing-on and thereafter is retracted out through the aperture 36.

The magazine of FIGS. 3–5 may be arranged, for example, on the front side of the drill unit and pivotal about an axle which is in parallel with the drill rod, for example the central axle which 48 (FIG. 8) of the sprocket wheel 35, and at drill bit exchange be pivoted such that the aperture 36 is located in front of the drill rod 3.

The chain 33 including arms 31, sprocket wheels 34, 35 and holder 49 is preferably designed as a cartridge for a simple recharge of the magazine 30.

The different devices, the piston-cylinder units 13 and 16 and the rotation means 21 in FIG. 1 and, respectively, the piston-cylinder unit 46 and rotation means 47 in FIG. 4, which control the device for drill bit exchange according to the invention, preferably are actuated from the normal working place of the drill operator.

What we claim is:

1. A drilling apparatus containing an arrangement for disengaging worn bits from the end of a drill rod and then engaging an unworn drill bit on the end of the drill rod, comprising in combination:

a. a support frame which is adapted to support at least one drill rod, said support frame including means to both rotate a drill rod and to move it in the direction of its longidutinal axis, b. a drill bit gripping means that is adapted to sequentially (1) grip a worn drill bit that is threaded on the end of a drill rod and to facilitate disengagement of the worn drill bit from the drill rod by relative movement between the drill rod and the gripping means and then (2) position a new drill bit against the end of the drill rod and to facilitate threading of the new drill bit on the end of the drill rod by relative movement between the drill rod and the gripping means, c. means for moving said drill bit gripping means from a non-operative position, where the gripping means is out of axial alignment with the drill rod, to an operative position, where the gripping means is both in axial alignment with said drill rod and engageable with the drill bit on the end of the drill rod, d. said drill bit gripping means including a casing and a wrench member that is axially movable in the casing said casing receiving the drill bit during the threading and unthreading of the drill bit from the drill rod.

2. A drilling apparatus containing an arrangement for disengaging worn bits from the end of a drill rod and then engaging an unworn drill bit on the end of the drill rod, comprising in combination:

a. a support frame which is adapted to support at least one drill rod, said support frame including means to both rotate a drill rod and to move it in the direction of its longitudinal axis, b. a drill bit gripping means that is adapted to sequentially (1) grip a worn drill bit that is threaded on the end of a drill rod and to facilitate disengagement of the worn drill bit from the drill rod by relative movement between the drill rod and the gripping means and then (2) position a new drill bit against the end of the drill rod and to facilitate threading of the new drill bit on the end of the drill rod by relative movement between the drill rod and the gripping means, and c. means for moving said drill bit gripping means from a non-operative position where the gripping means is out of axial aligment with the drill rod, to an operative position, where the gripping means is both in axial alignment with said drill rod and engageable with the drill bit on the end of the drill rod.

3. A drilling apparatus containing an arrangement for disengaging worn bits from the end of a drill rod and then engaging an unworn drill bit on the end of the drill rod, comprising in combination:

a. a support frame which is adapted to support at least one drill rod, said support frame including means to both rotate a drill rod and to move it in the direction of its longitudinal axis, b. a drill bit gripping means that is adapted to sequentially (1) grip a worn drill bit that is threaded on the end of a drill rod and to facilitate disengagement of the worn drill bit from the drill bit from the drill rod by relative movement between the drill rod and the gripping means and then (2) position a new drill bit against the end of the drill rod and to facilitate threading of the new drill bit on the end of the drill rod by relative movement between the drill rod and the gripping means, c. means for moving said drill bit gripping means from a non operative position, where the gripping means is out of axial alignment with the drill rod, to an operative position, where the gripping means is both in axial alignment with said drill rod and engageable with the drill bit on the end of the drill rod, and d. a magazine containing a plurality of drill bits, said magazine being positioned between the end of a drill rod and said drill bit gripping means and being rotatable so as to both carry away worn bits and supply new bits.

4. An apparatus according to claim 3 wherein said magazine includes a plurality of bushings that hold the drill bit prior to and during the time that a drill bit is engaged with the end of a drill rod.

5. An apparatus according to claim 3 which includes a piston cylinder means for moving said drill bit gripping means into contact with the drill bit and out of contact with the drill bit.

6. An apparatus according to claim 3 wherein the drill bit gripping means is pivotally supported on said support frame and said apparatus includes a piston cylinder means to move said drill bit gripping means from said operative position to a non-operative position.

7. An apparatus according to claim 3 wherein the drill bit gripping means includes a sleeve-shaped wrench member for substantially non-rotatably receiving a drill bit therein.

8. An apparatus according to claim 7 wherein said sleeve-shaped wrench member is restrictedly rotatable between end stop members on the drill bit gripping means so as to enable it to bring about a striking effect to break the thread connection between the drill bit and the drill rod.

9. A drilling apparatus containing an arrangement for disengaging worn bits from the end of a drill rod and then engaging a new drill bit on the end of the drill rod, comprising in combination:

a. a support frame which is adapted to support at least one drill rod, said support frame including means to both rotate a drill rod and to move it in the direction of its longitudinal axis, b. a magazine member for successively positioning drill bits adjacent the end of a drill rod, c. means for rotating said magazine member so that a new drill bit can be brought into axial alignment with the drill rod, d. a locking means for locking a drill bit against rotation while it is in axial alignment with a drill rod, and e. means for moving said locking means into and out of axial alignment with said drill rod.

10. A drilling apparatus containing an arrangement for disengaging worn bits from the end of a drill rod and then engaging an unworn drill bit on the end of the drill rod, comprising in combination:

a. a support frame which is adapted to support at least one drill rod, said support frame including means to both rotate a drill rod and to move it in the direction of its longitudinal axis, b. a magazine means containing a plurality of drill bits, c. means for bringing any selected drill bit in said magazine into alternate engaging and disengaging relationship with the end of a drill rod, and d. means for effecting relative rotational movement between the drill rod and a selected drill bit so as to effect either engagement or disengagement thereof.

11. A drilling apparatus containing an arrangement for disengaging worn bits from the end of a drill rod and then engaging an unworn drill bit on the end of the drill rod, comprising in combination:

a. a support frame which is adapted to support at least one drill rod, said support frame including means to both rotate a drill rod and to move it in the direction of its longitudinal axis, b. a carrier means for drill bits located adjacent one end of said support frame and mounted so that it can move a drill bit into and out of axial alignment with the end of a drill rod, c. a drill bit gripping means that is adapted to sequentially (1) grip a worn drill bit that is threaded on the end of a drill rod and to facilitate disengagement of the worn drill bit from the drill rod by relative movement between the drill rod and the gripping means and then (2) position a new drill bit carried by said carrier means against the end of the drill rod and to facilitate threading of the new drill bit on the end of the drill rod by relative movement between the drill rod and the gripping means, and d. means for moving said drill bit gripping means from a non operative position, where the gripping means is out of axial alignment with the drill rod to an operative position, where the gripping means is both in axial alignment with said drill rod and engageable with the drill bit on the end of the drill rod.

12. In a rock drilling machine that includes at least one drill rod that is designed to drill through rocks when it has a drill bit attached to the end thereof, the improvement which comprises the combination of a. means for gripping and holding a drill bit that is located on the end of a drill rod so that when said drill rod is rotated in a direction so as to disengage a drill rod and drill bit the drill bit will not rotate, b. means to rotate said drill rod so as to disengage it from its drill bit, c. means to remove the disengaged drill bit from the area of disengagement and to bring to said area of disengagement a new drill bit, d. means to bring the new drill bit into end-to-end alignment with the drill rod so that when the drill rod is rotated in the engaging direction the new drill bit will be fixed on the end of the drill rod.

* * * * *